US005121704A

United States Patent [19]

Whitaker et al.

[11] Patent Number: 5,121,704

[45] Date of Patent: Jun. 16, 1992

[54] UNITARY TILTING TONER/VACUUM HEAD FOR ELECTROSTATIC PRINTERS/PLOTTERS

[75] Inventors: Angus H. Whitaker, Monte Sereno; Ronald W. Franck, Garden Grove, both of Calif.

[73] Assignee: Calcomp Inc., Anaheim, Calif.

[21] Appl. No.: 673,769

[22] Filed: Mar. 20, 1991

[51] Int. Cl.[5] ..... G03G 15/10; G03G 15/01

[52] U.S. Cl. ..... 118/660; 118/645; 355/256

[58] Field of Search ..... 355/256, 326; 118/645, 118/652, 659, 660

[56] References Cited

FOREIGN PATENT DOCUMENTS 60-83966 5/1985 Japan ..... 355/256

1-185570 7/1989 Japan ..... 355/256

*Primary Examiner*—Joan H. Pendegrass

*Attorney, Agent, or Firm*—Donald A. Streck; Wm. F. Porter, Jr.

[57] ABSTRACT

This invention is a two-color unitary application and vacuuming head for a liquid toner electrostatic printing system. There is a body having three planar faces angularly displaced from one another concentrically about a pivot point, one of the faces being a first toner face having openings therein communicating with a first network of toner passages in the body, a second of the faces being a second toner face having openings therein communicating with a second network of toner passages in the body, a third of the faces being a vacuum face also having individual openings therein communicating respectively with a third network of toner passages in the body and with a fourth network of toner passages in the body. A pivot pin supports the body for pivotal movement about the pivot point and there is apparatus for pivoting the body about the pivot pin between a first position with the first toner face in contact with a printing media being printed upon by the printing system, a second position with the vacuum face in contact with the printing media, and a third position with the second toner face in contact with the printing media.

7 Claims, 2 Drawing Sheets

UNITARY TILTING TONER/VACUUM HEAD FOR ELECTROSTATIC PRINTERS/PLOTTERS

BACKGROUND OF THE INVENTION

The present invention relates to electrostatic printers and plotters employing liquid toner and, more particularly, to a unitary application/vacuuming head for a liquid toner electrostatic printing system comprising, a body having two planar faces angularly displaced from one another concentrically about a pivot point, one of the faces being a first tone face having openings therein communicating with a first network of toner passages in the body and the other of the faces being a vacuum face also having openings therein communicating with a second network of toner passages in the body; a pivot pin supporting the body for pivotal movement about the pivot point; and, pivot means for pivoting the body about the pivot pin between a first position with the first toner face in contact with a printing media being printed upon by the printing system and a second position with the vacuum face in contact with the printing media.

In the well-known xerographic photocopying process, copies of a document are made by optically viewing the document and creating an electrostatic copy of the document on a drum or belt. A powdered toner is then applied to the drum or belt, which toner adheres to the electrostatic charges in the pattern of the document. The pattern of toner is then transferred to a plain sheet of paper and fused to the paper with heat to create the desired copy of the document. Electrostatic printers and plotters employing liquid toner are less well known; but, are quite popular in the art, especially for larger documents and computer-degenerated outputs such as produced by Computer Aided Drafting (CAD) systems. Whether the device is a printer printing text or a plotter printing graphics the basic electrostatic operation is the same. Thus, for ease of terminology hereinafter, we will refer simply to a plotter with those skilled in the art recognizing that the present invention would work equally well in a printer.

A basic prior art electrostatic plotter employing liquid toner is shown in very simplified form in FIG. 1. The primary advantage of the plotter 10 of FIG. 1 over the above-described dry toner photocopying process is that there is no drum or belt. The electrostatic image is produced directly on the bottom surface of the copy paper 12. The paper 12 is typically a strip from a supply roll 14 moved back and forth over the elements to be described (as indicated by the arrow 16) to create the "plot" thereon by apparatus which is not shown in the drawing as being irrelevant to the present invention. An electrostatic charge is applied to the paper 12 by an electrostatic printing head 18 of a type well known to those skilled in the art. The paper 12 with the electrostatic charge on the bottom surface thereof then moves over a toner head 20 where liquid toner 22 from a sump 24 is circulated over the bottom surface of the paper 12 by a pump 26. The paper 12 with a film of the toner 22 clinging to the electrostatic charge on the bottom surface thereof then moves over a vacuum knife 28 where remaining excess liquid toner 22 is removed and returned to the sump 24 by a vacuum pump 30. If the printing process is in multiple colors, either multiple toner heads 20 and vacuum knifes 28 can be employed or the single toner head 20 and vacuum knife 28 can be purged with clear toner vehicle between colors. In either event, however, it can be appreciated that there is much forward and backward movement of the paper 12 and many parts involved in the process.

Wherefore, it is an object of the present invention to provide a unitary toner head and vacuum knife for use in an electrostatic plotter employing liquid toner so as to reduce the number of parts required in the plotter.

It is another object of the present invention to provide a unitary toner head and vacuum knife for use in an electrostatic plotter employing liquid toner so as to reduce the amount of forward and backward movement of the paper required in the plotter.

It is still another object of the present invention to provide a unitary toner head and vacuum knife for use in an electrostatic plotter employing liquid toner which can apply more than one color of toner in a single head without requiring purging between colors.

Other objects and benefits of the invention will become apparent from the description which follows hereinafter when taken in conjunction with the drawing figures which accompany it.

SUMMARY

The foregoing objects have been achieved in the unitary application/vacuuming head for a liquid toner electrostatic printing system of the present invention comprising, a body having two planar faces angularly displaced from one another concentrically about a pivot point, on of the faces being a first toner face having openings therein communicating with a first network of toner passages in the body and the other of the faces being a vacuum face also having openings therein communicating with a second network of toner passages in the body; a pivot pin supporting the body for pivotal movement about the pivot point; and, pivot means for pivoting the body about the pivot pin between a first position with the first toner face in contact with a printing media being printed upon by the printing system and a second position with the vacuum face in contact with the printing media.

The preferred embodiment additionally comprises an arcuate guide track attached to the head and concentrically disposed about the pivot point, the track having an arcuate slot therein also concentrically disposed about the pivot point; and, a guide pin disposed in the slot.

For use with two colors, the preferred embodiment also includes, the body further including a second toner face angularly displaced from the vacuum face and opposite the first toner face concentrically about the pivot point; the second toner face having openings therein communicating with a third network of toner passages in the body; and, the vacuum face including openings therein communicating with a fourth network of toner passages in the body. Preferably, the pivot means also includes means for pivoting the body about the pivot pin to a third position with the second toner face in contact with the printing media.

DESCRIPTION OF THE PREFERRED EMBODIMENT

Figures 1, 2:
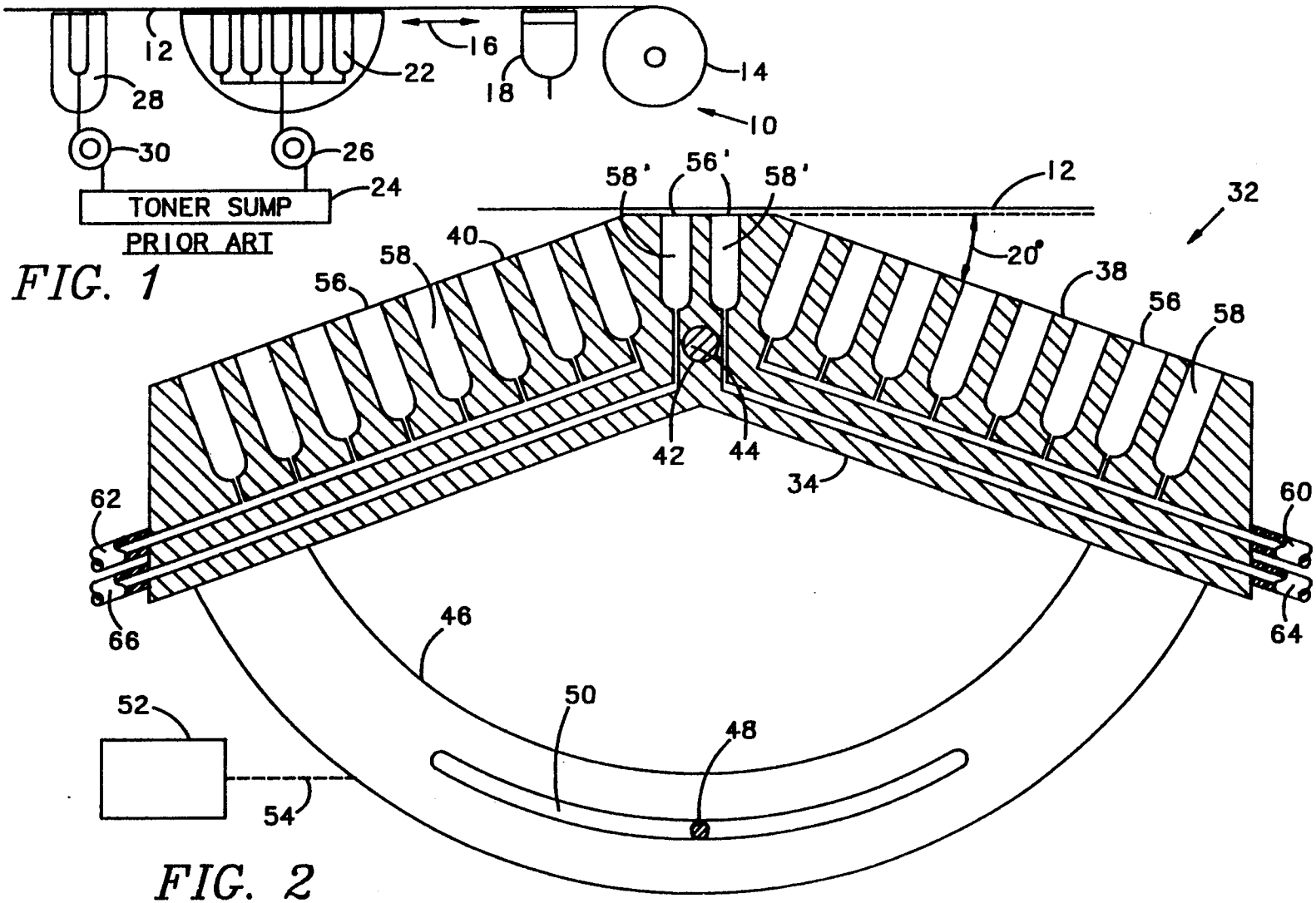
FIG. 1 is a simplified drawing of the separate toner head and vacuum head components as employed in the prior art for electrostatic printers and plotters.
FIG. 2 is an enlarged, partially cutaway drawing of a two-color, unitary, tilting toner/vacuum head for electrostatic printers and plotters according to the present invention.

A tilting toner head 32 according to the present invention in a preferred embodiment capable of applying and vacuuming two colors of toner without purging is depicted in FIG. 2. The head 32 comprises a body 34 having three planer faces 36, 38, and 40 displaced from one another by about 20° as indicated in the drawing. The head 32 is shown in a neutral or vacuuming position in FIG. 2 with the central or vacuum face 36 horizontally disposed parallel to the bottom surface of the paper 12 above it. One toner face 38 angles down from the face 36 about 20° on one side thereof and the other toner face 40 angles down from the face 36 about 20° on the opposite side thereof. A pivot point 42 is disposed at a juncture point below the three faces 36, 38, 40 so that the head 32 can be pivoted about the pivot portion 42 in either direction to selectively place the other faces 38, 40 horizontally disposed parallel to the bottom surface of the paper 12 above them. For this purpose, the head 32 is mounted on a pivot pin 44 carried by the plotter in which it is mounted. Additionally for stability, it is preferred that there be an arcuate guide track 46 attached to the head 32 and concentrically disposed about the pivot point 42 and that there by a guide pin 48 carried by the plotter in which it is mounted moving in an arcuate slot 50 in the guide track 46. The head 32 can be tilted by a mechanism 52 operably connected thereto as indicated by the dashed line 54 in any of several ways which wold be obvious to those skilled in the art without undue experimentation, which form no part of the present invention.

The one toner face 38 has openings 56 therein communicating with a network of toner passages 58 therein communicating with a toner sump 24 for a first color though a connecting line 60. In like manner, the other toner face 40 has openings 56 therein communicating with a network of toner passages 58 therein communicating with a toner sump 24 for a second color through a connecting line 62. The vacuum face 36 has also has openings 56' therein communicating with passages 58' therein communicating with the toner sumps 24 for the first and second colors through respective connecting lines 64 and 66.

Figure 4:
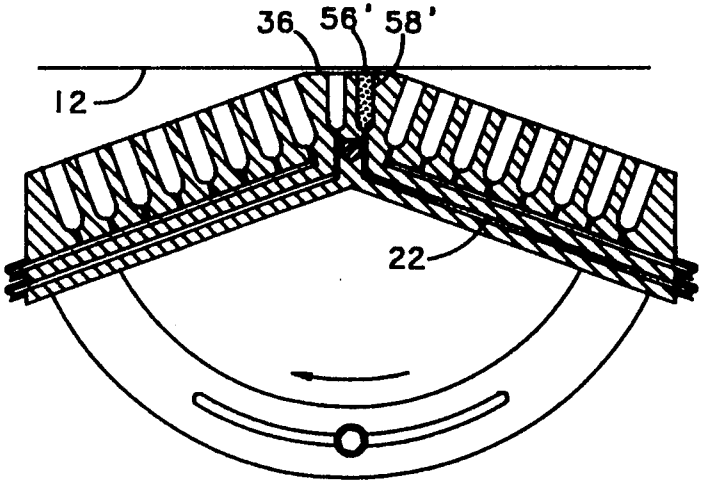
FIGS. 3–6 depict the manner in which the head of FIG. 2 is used.
Figure 3:
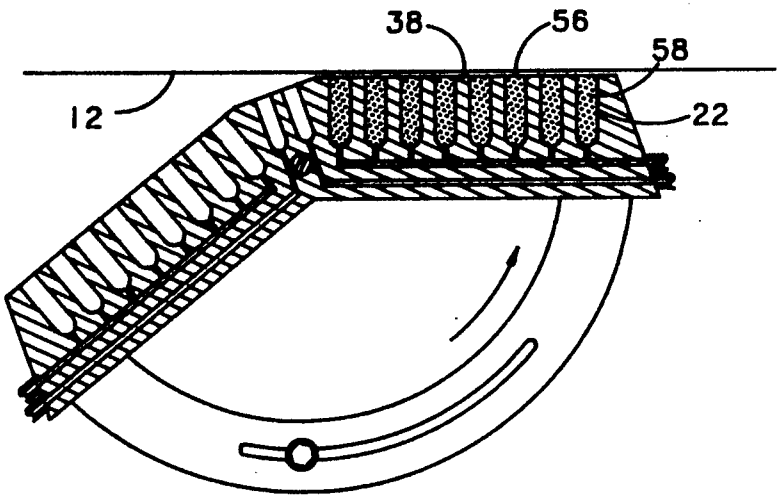
Figure 6:
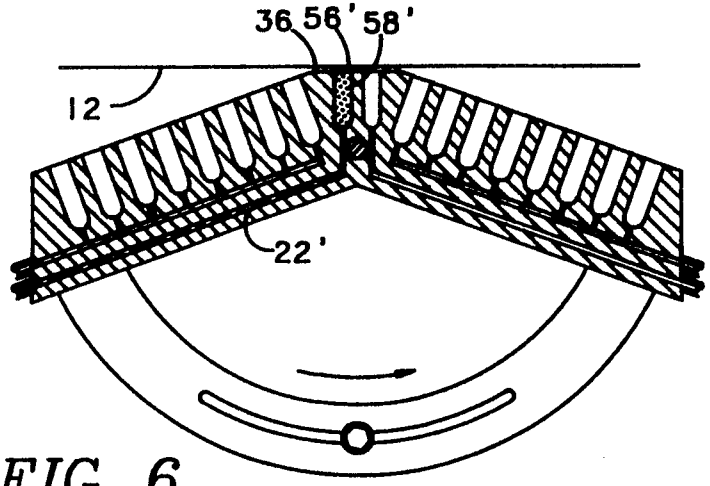
Figure 5:
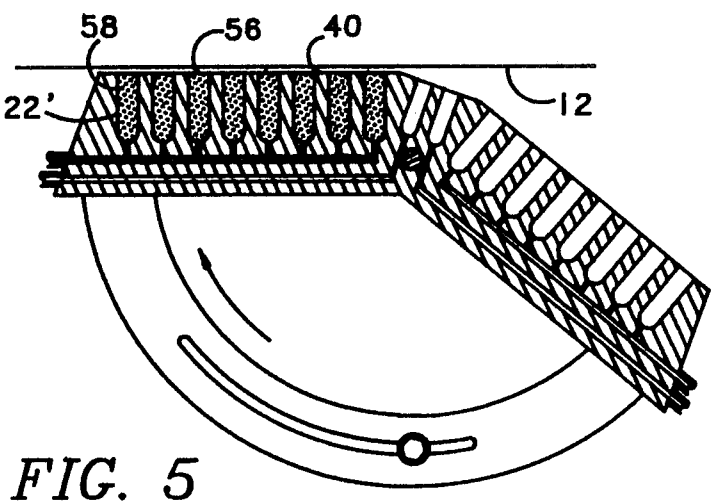

The operation of a plotter employing the head 32 of FIG. 2 is shown in FIGS. 3–6. Those aspects of the electrostatic plotting process which are standard will not be addressed in the interest of simplicity. Likewise, as those skilled in the art will readily recognize and appreciate, the head 32 could be build as one toner head with an integral vacuum knife. Alteratively, multiple heads 32 could be employed for more than two colors. For example, two heads as in FIG. 2 could be used for the three colors required for full color printing plus black. As depicted in FIG. 3, the first toner face 38 is first pivoted into contact with the paper 12 and toner 22 flowed through the passages 58 thereof to contact the paper 12 through the openings 56 thereof. As depicted in FIG. 4, the head 32 is then pivoted to place the vacuum face 36 in contact with the paper so that the excess toner 22 can be vacuumed from the paper 12 with one of the openings 56'. For the next color, the second toner face 40 is pivoted into contact with the paper 12 and toner 22' flowed through the passages 58 thereof to contact the paper 12 through the openings 56 thereof as depicted in FIG. 5. Finally, as depicted in FIG. 6, the head 32 is once again pivoted to place the vacuum face 36 in contact with the paper so that the excess toner 22' can be vacuumed from the paper 12 with the other one of the openings 56'.

Thus, it can be seen from the foregoing description and the accompanying drawings that the present invention has truly met is stated objects by providing a unitary head providing both toner applying and toner vacuuming function in a single location which may, if desired, provide such functions for two toner colors.

Wherefore, having thus described the present invention, what is claimed is:

1. A unitary application/vacuuming head for a liquid toner electrostatic printing system comprising:

a) a body having two planer faces angularly displaced from one another concentrically bout a pivot point, one of said faces being a first toner face having openings therein communicating with a first network of toner passages in said body and the other of said faces being a vacuum face also having openings therein communicating with a second network of toner passages in said body;

b) a pivot pin supporting said body for pivotal movement about said pivot point;

c) pivot means for pivoting said body about said pivot pin between a first position with said first toner face in contact with a printing media being printed upon by the printing system and a second position with said vacuum face in contact with said printing media;

d) an arcuate guide track attached to said head an concentrically disposed about said pivot point, said track having an arcuate slot therein also concentrically disposed about said pivot point; and, c) a guide pin disposed in said slot.

2. The unitary application/vacuuming head for a liquid toner electrostatic printing system of claim 1 wherein:

a) said body further includes a second other face angularly displaced from said vacuum face and opposite said first toner face concentrically about said pivot point;

b) said second toner face has openings therein communicating with a third network of toner passages in said body; and, c) said vacuum face includes openings therein communicating with a fourth network of toner passages in said body.

3. The unitary application/vacuuming had for a liquid toner electrostatic printing system of claim 2 wherein:

said pivot means includes means for pivoting said body about said pivot pin to a third position with said second toner face in contact with said printing media.

4. A two-color unitary application/vacuuming head for a liquid toner electrostatic printing system comprising:

a) a body having three planar faces angularly displaced from one another concentrically about a pivot point, one of said faces being a first toner face having openings therein communicating with a first network of toner passages in said body, a second of said faces being a second toner face having openings therein communicating with a second network of toner passages in said body, a third of said faces being a vacuum face also having individual openings therein communicating respectively with a third network of toner passages in said body and with a fourth network of toner passages in said body;

b) a pivot pin supporting said body for pivotal movement about said pivot point; and, c) pivot means for pivoting said body about said pivot pin between a first position with said first toner face in contact with a printing media being printed upon by the printing system, a second position with said vacuum face in contact with said printing media, and a third position with said second toner face in contact with said printing media.

5. The unitary application/vacuuming head for a liquid toner electrostatic printing system of claim 4 and additionally comprising:

a) an arcuate guide track attached to said head and concentrically disposed about said pivot point, said track having an arcuate slot therein also concentrically disposed about said pivot point; and, b) a guide pin disposed in said slot.

6. A two-color unitary application/vacuuming head for a liquid toner electrostatic printing system comprising:

a) a body having three planar faces angularly displaced from one another concentrically about a pivot point, one of said faces comprising first toner interface means for communicating with a first network of toner passages in said body, a second of said faces comprising second toner interface means for communicating with a second network of toner passages in said body, a third of said faces comprising vacuum interface for selectively communicating respectively with a third network of toner passages in said body and with a fourth network of toner passages in said body;

b) pivot pin means supporting said body for pivotal movement about said pivot point; and, c) pivot means for pivoting said body about said pivot pin means between a first position with said first toner interface means in contact with a printing media being printed upon by the printing system, a second position with said vacuum interface means in contact with said printing media, and a third position with said second toner interface means in contact with said printing media.

7. The unitary application/vacuuming head for a liquid toner electrostatic printing system of claim 6 and additionally comprising:

guide track means attached to said head and disposed about said pivot point for guiding said body in pivoting movement about said pivot pin means between said first position, said second position, and said third position.

* * * * *